US011629570B2

(12) United States Patent
Berthaud et al.

(10) Patent No.: US 11,629,570 B2
(45) Date of Patent: Apr. 18, 2023

(54) BLOWOUT PREVENTER WITH REDUCED FLUID VOLUME

(71) Applicant: Schlumberger Technology Corporation, Sugar Land, TX (US)

(72) Inventors: Pascal Berthaud, Beziers (FR); Mohamed Kouba, Beziers (FR); Benoit Jauzion, Beziers (FR); Florent Vargas, Beziers (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/650,098

(22) Filed: Feb. 7, 2022

(65) Prior Publication Data

US 2022/0251918 A1 Aug. 11, 2022

Related U.S. Application Data

(60) Provisional application No. 63/199,974, filed on Feb. 5, 2021.

(51) Int. Cl.
*E21B 33/035* (2006.01)
*E21B 33/06* (2006.01)

(52) U.S. Cl.
CPC ..... *E21B 33/0355* (2013.01); *E21B 33/06* (2013.01)

(58) Field of Classification Search
CPC ..... E21B 33/06; E21B 33/063; E21B 33/0355
USPC ..... 251/1.3; 166/363, 364
See application file for complete search history.

(56) References Cited

U.S. PATENT DOCUMENTS

| | | | | |
|---|---|---|---|---|
| 4,349,041 | A * | 9/1982 | Bates | F15B 11/024 251/1.2 |
| 4,509,405 | A * | 4/1985 | Bates | E21B 34/16 251/1.2 |
| 6,244,560 | B1 * | 6/2001 | Johnson | E21B 33/063 92/61 |
| 8,651,190 | B2 * | 2/2014 | Dietz | E21B 33/063 166/368 |
| 8,857,175 | B2 * | 10/2014 | Geiger | F15B 21/006 60/534 |
| 9,175,538 | B2 * | 11/2015 | Wordley | E21B 33/064 |
| 10,132,135 | B2 * | 11/2018 | Gaude | E21B 33/0355 |
| 10,378,301 | B2 * | 8/2019 | Alhat | F16K 51/00 |
| 10,570,690 | B2 * | 2/2020 | Alhat | E21B 33/063 |
| 10,851,805 | B2 * | 12/2020 | Thomson | F15B 1/24 |

* cited by examiner

*Primary Examiner* — Umashankar Venkatesan
(74) *Attorney, Agent, or Firm* — Kelly McKinney

(57) ABSTRACT

A system for operating a blowout preventer (BOP) includes a front piston positioned at least partially in a front chamber. The front chamber includes a front volume on a front side of the front piston, and a back volume on a back side of the front piston. The system also includes a back piston connected to the front piston. The back piston is positioned at least partially in a back chamber. The back chamber includes a front volume on a front side of the back piston, and a back volume on a back side of the back piston. The system also includes a first valve configured to permit fluid flow into the front chamber during a free closing stroke of the BOP. The system also includes a second valve configured to permit fluid flow between the front and back volumes of the back chamber during the free closing stroke.

20 Claims, 9 Drawing Sheets

BLOWOUT PREVENTER WITH REDUCED FLUID VOLUME

CROSS-REFERENCE TO RELATED APPLICATIONS

This application claims priority to U.S. Provisional Patent Application No. 63/199,974, filed on Feb. 5, 2021, the entirety of which is incorporated by reference herein.

BACKGROUND

A blowout preventer (BOP) refers to a large valve at the top of a well that may be closed if the drilling crew loses control of formation fluids. By closing this valve (e.g., remotely via hydraulic actuators), the drilling crew may regain control of the reservoir, and procedures can then be initiated to increase the mud density until it is possible to open the BOP and retain pressure control of the formation.

Currently, to close a BOP with two (e.g., tandem) pistons, a first volume ($V_1$) of hydraulic fluid is used to actuate the first piston, and a second volume ($V_2$) of hydraulic fluid is used to actuate the second piston. Similarly, to open the BOP with two pistons, a third volume ($V_3$) of hydraulic fluid is used to actuate the first piston, and a fourth volume ($V_4$) of hydraulic fluid is used to actuate the second piston. Thus, the total volume ($V_{total}$) of hydraulic fluid used by the system may be $V_1+V_2+V_3+V_4$. The total volume $V_{total}$ may be stored in a subsea system. As will be appreciated, transporting and installing large amounts of equipment and fluids in a subsea environment is difficult and expensive. Therefore, what is needed is a system and method for operating a BOP with a reduced fluid volume.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system for operating a blowout preventer (BOP) is disclosed. The system includes a front piston positioned at least partially in a front chamber. The front chamber includes a front volume on a front side of the front piston, and a back volume on a back side of the front piston. The system also includes a back piston connected to the front piston. The back piston is positioned at least partially in a back chamber. The back chamber includes a front volume on a front side of the back piston, and a back volume on a back side of the back piston. The system also includes a first valve configured to permit fluid flow into the front chamber during a free closing stroke of the BOP. The system also includes a second valve configured to permit fluid flow between the front and back volumes of the back chamber during the free closing stroke.

In another embodiment, the system includes a front piston positioned at least partially in a front chamber. The front chamber includes a front volume on a front side of the front piston, and a back volume on a back side of the front piston. The system also includes a back piston connected to the front piston. The back piston is positioned at least partially in a back chamber. The back chamber includes a front volume on a front side of the back piston, and a back volume on a back side of the back piston. The system also includes a ram connected to the front piston. The system also includes a first valve. The first valve is configured to permit fluid flow from a tank to the back volume of the front chamber to push the front piston toward a closing position during a free closing stroke of the BOP. The first valve is also configured to permit fluid flow from the tank to the back volumes of the front and back chambers to push the front and back pistons toward the closing positions during a shearing stroke of the BOP, which causes the ram to shear a tubular member. The first valve is also configured to permit fluid flow from the tank to the front volume of the front chamber to push the front piston toward an open position during an opening stroke of the BOP. The system also includes a second valve. The second valve is configured to permit fluid flow between the front and back volumes of the back chamber during the free closing stroke. The second valve is also configured to prevent fluid flow between the front and back volumes of the back chamber during the shearing stroke. The second valve is also configured to permit fluid flow between the front and back volumes of the back chamber during the opening stroke. The system also includes a third valve. The third valve is configured to cause the second valve to permit fluid flow between the front and back volumes of the back chamber during the free closing stroke in response to a pressure in the back volumes of the first and second chambers being less than a predetermined threshold. The third valve is also configured to cause the second valve to prevent fluid flow between the front and back volumes of the back chamber during the shearing stroke in response to a pressure in the back volumes of the first and second chambers being greater than the predetermined threshold. The third valve is also configured to cause the second valve to permit fluid flow between the front and back volumes of the back chamber during the opening stroke in response to the pressure in the back volumes of the first and second chambers being less than the predetermined threshold.

A method for operating a blowout preventer (BOP) is also disclosed. The method includes performing a free closing stroke with front and back pistons. The front piston is positioned at least partially within a front chamber. The back piston is positioned at least partially within a back chamber. Performing the free closing stroke includes pumping fluid through a first valve and into a back volume of the front chamber to push the front piston toward a closing position. Performing the free closing stroke also includes actuating a second valve to permit fluid flow between front and back volumes of the back chamber. The second valve is actuated by a third valve in response to a pressure in the back volumes of the front and back chambers being less than a predetermined threshold.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
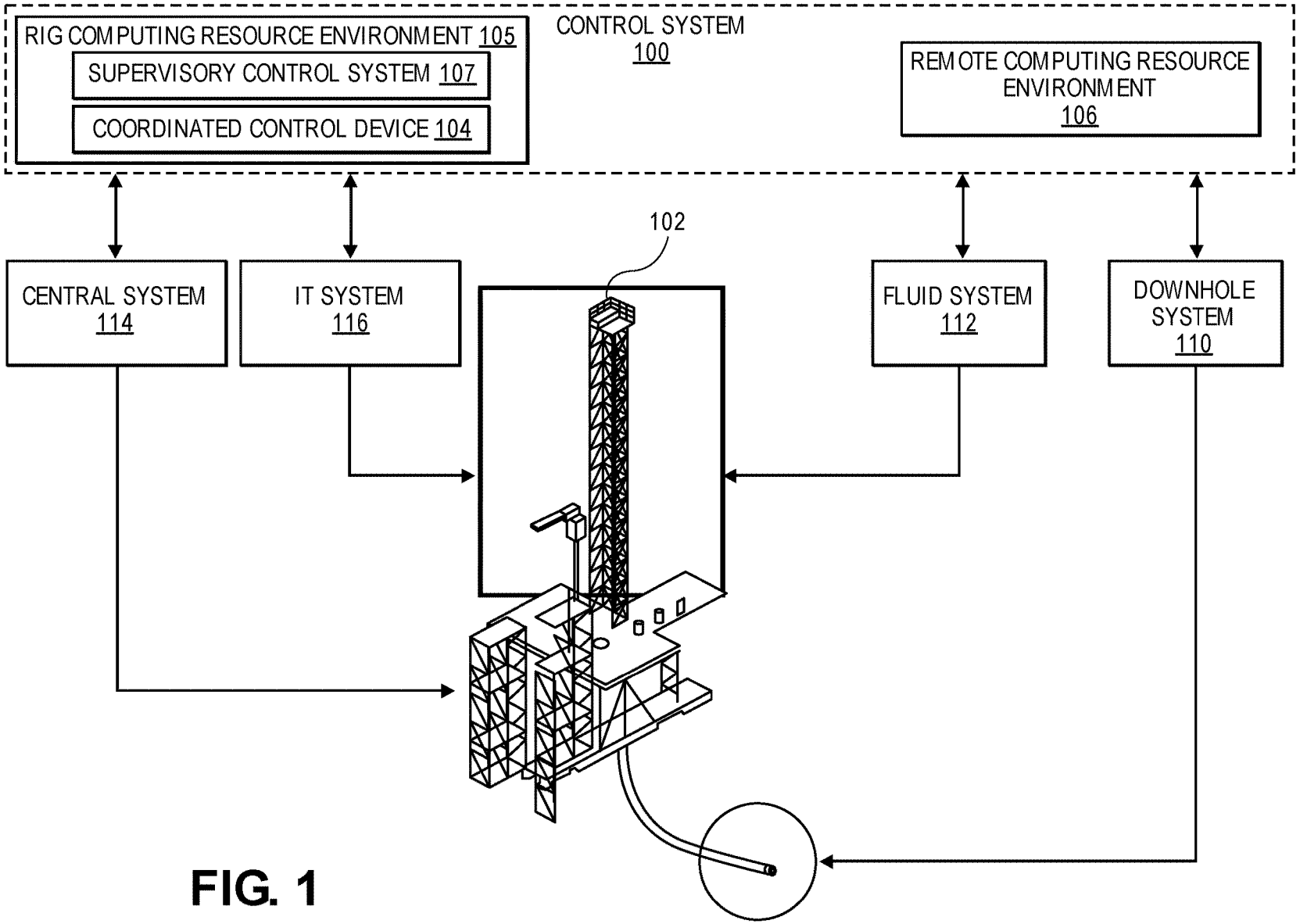
FIG. 1 illustrates a conceptual, schematic view of a control system for a drilling rig, according to an embodiment.

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottomhole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
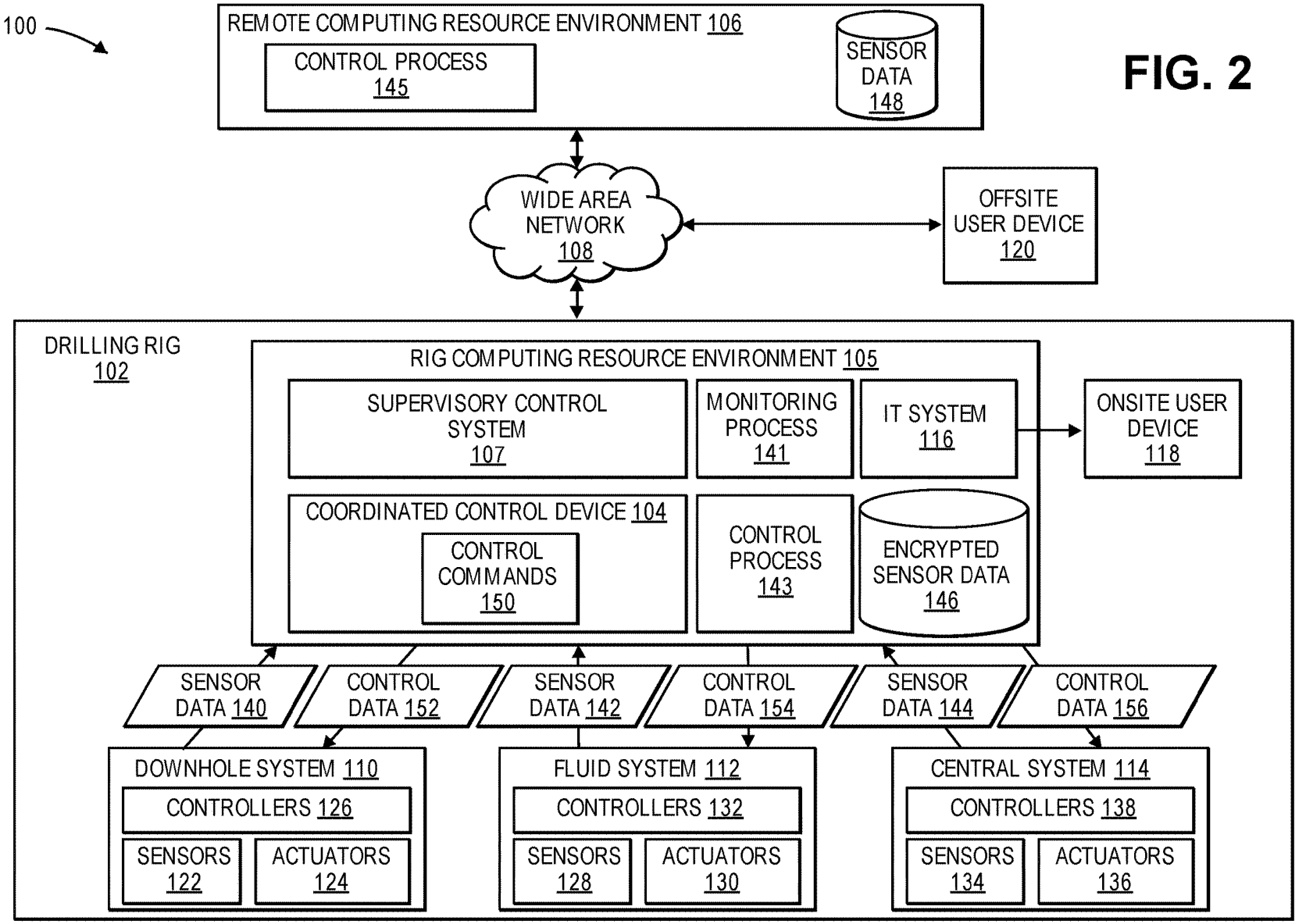
FIG. 2 illustrates a conceptual, schematic view of the control system, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

BOP with Reduced Fluid Volume

Figure 3:
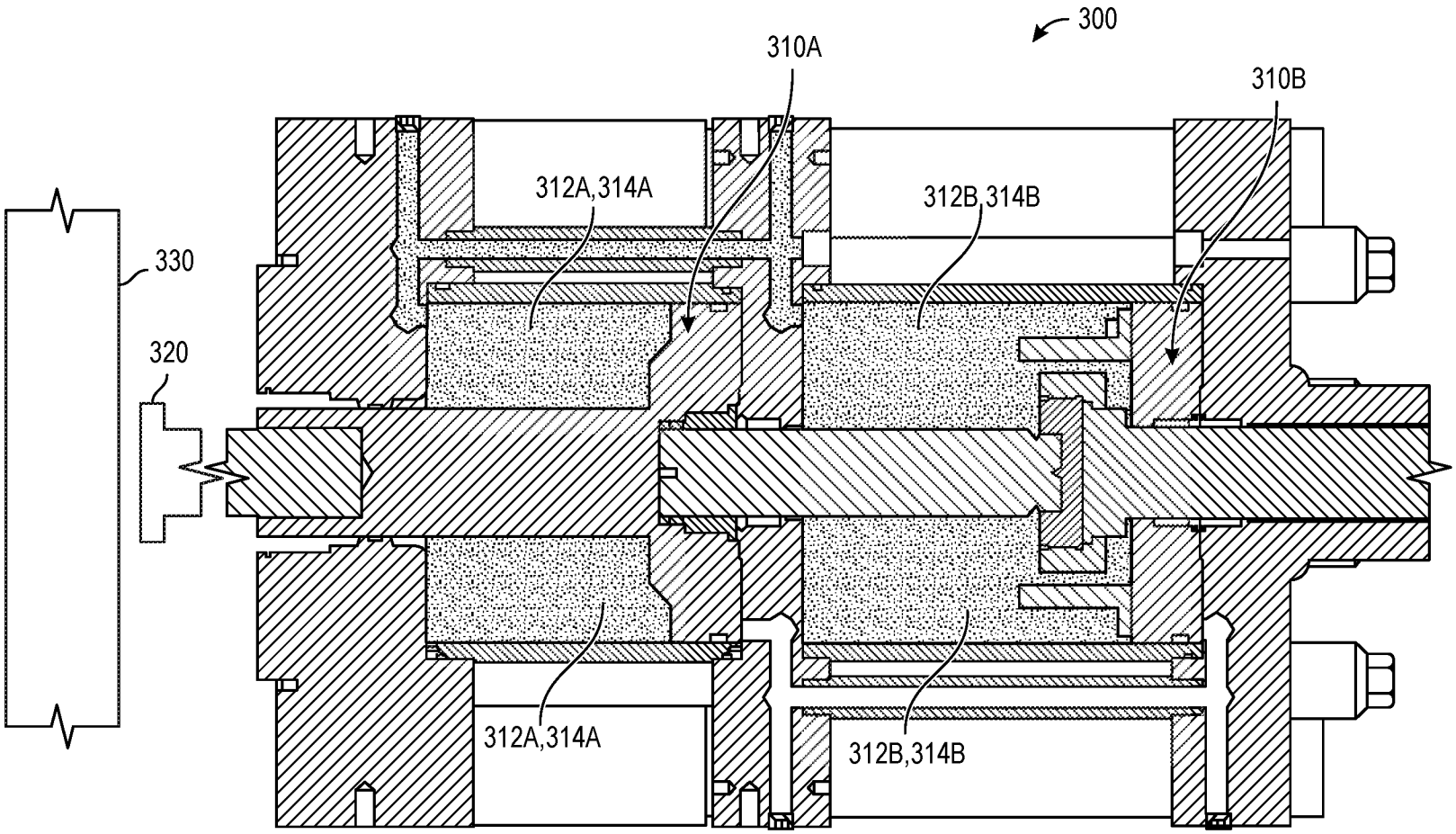
FIG. 3 illustrates a cross-sectional side view of a portion of a blowout preventer (BOP) with two pistons in a first (e.g., open) position, according to an embodiment.
Figure 4:
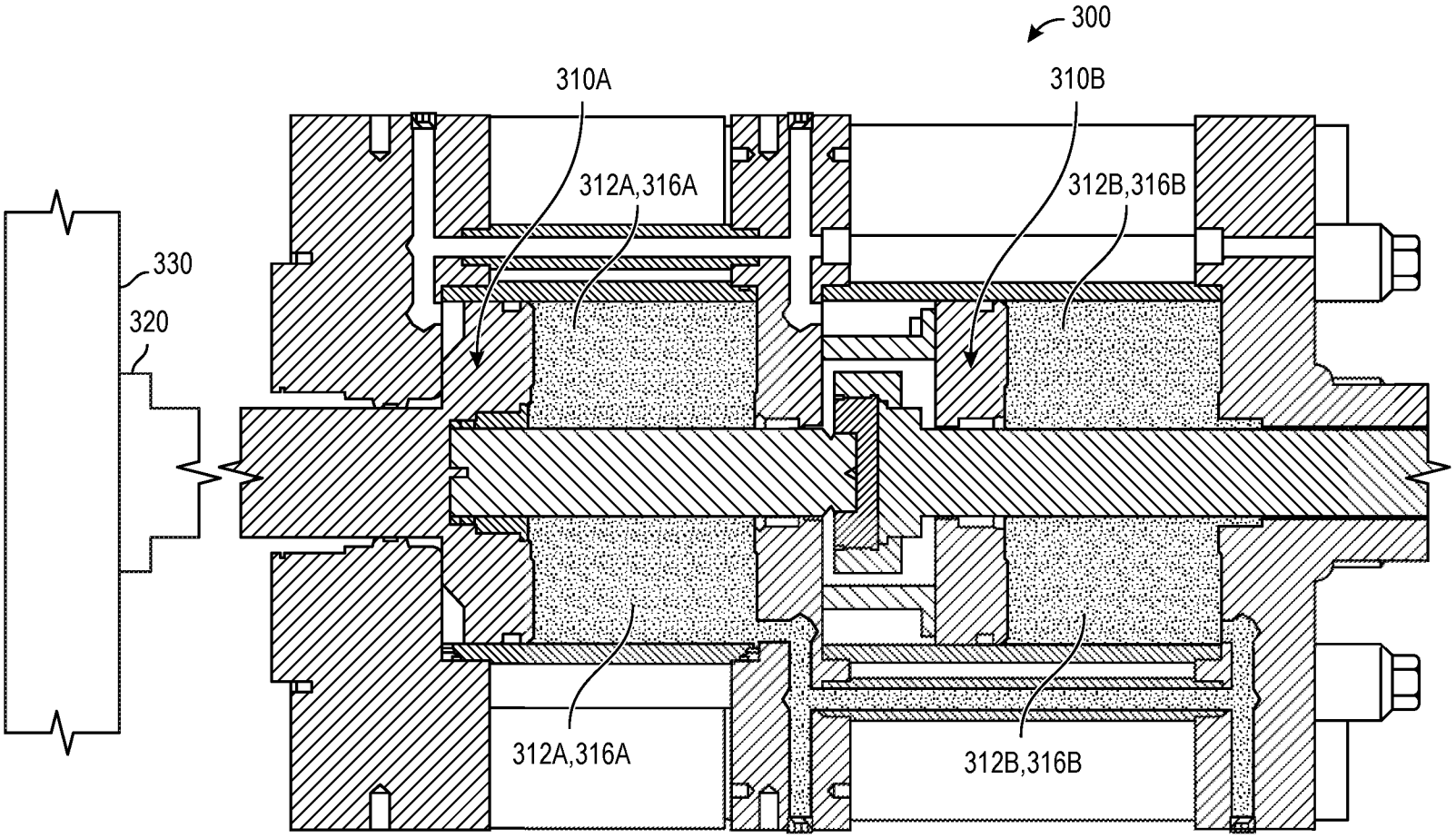
FIG. 4 illustrates a cross-sectional side view of a portion of the BOP with the two pistons in a second (e.g., closed) position, according to an embodiment.

FIG. 3 illustrates a cross-sectional side view of a portion of a blowout preventer (BOP) 300 with two pistons 310A, 310B in a first (e.g., open) position, and FIG. 4 illustrates a cross-sectional side view of the portion of the BOP 300 with the two pistons 310A, 310B in a second (e.g., closed) position, according to an embodiment. The pistons may include a first (e.g., front) piston 310A and a second (e.g., back) piston 310B. The pistons 310A, 310B may be connected together and thus move together (also referred to as tandem boosters).

The piston 310A may be positioned at least partially within a first (e.g., front) chamber 312A within the BOP 300, and the piston 310B may be positioned at least partially within a second (e.g., back) chamber 312B within the BOP 300. The front chamber 312A may include a first (e.g., front) volume 314A on a first (e.g., front) side of the piston 310A. This is shown in FIG. 3. The front chamber 312A may also include a second (e.g., back) volume 316A on a second (e.g., back) side of the piston 310A. This is shown in FIG. 4. Similarly, the back chamber 312B may include a first (e.g., front) volume 314B on a first (e.g., front) side of the piston 310B. This is shown in FIG. 3. The second chamber 312B may also include a second (e.g., back) volume 316B on a second (e.g., back) side of the piston 310B. This is shown in FIG. 4.

In one embodiment, the back piston 310B may have a larger cross-sectional length (e.g., diameter) than the front piston 310A. As a result, the front and/or back volume 314B, 316B of the back chamber 312B may be larger than the front and/or back volume 314A, 316A of the front chamber 312A. In addition, the front and back volumes 314B, 316B of the back chamber 312B may be substantially the same size to allow for fluid transfer therebetween, as described below. In one embodiment, the front and back volumes 314A, 316A of the front chamber 312A may be substantially the same size or different sizes.

To actuate the pistons 310A, 310B from the open position (FIG. 3) to the closed position (FIG. 4), fluid may be pumped into the back volume(s) 316A and/or 316B. Pumping the fluid into the back volume(s) 316A and/or 316B may push the pistons 310A, 310B into the closed positions (to the left in FIGS. 3 and 4).

To actuate the pistons 310A, 310B from the closed position (FIG. 4) to the open position (FIG. 3), fluid may be pumped into the front volume(s) 314A and/or 314B. Pumping the fluid into the front volume(s) 314A and/or 314B may push the pistons 310A, 310B into the open positions (to the right in FIGS. 3 and 4).

The BOP 300 may also include one or more rams 320. As shown, the ram(s) 320 may be connected to (and configured to move together with) the front piston 310A. The ram(s) 320 may be spaced apart from a substantially vertical tubular member (e.g., a drill string) 330 when the pistons 310A, 310B are in the open position. The ram(s) 320 may be in contact with and/or configured to shear the drill string 330 when the pistons 310A, 310B are in the closed position.

Figure 5:
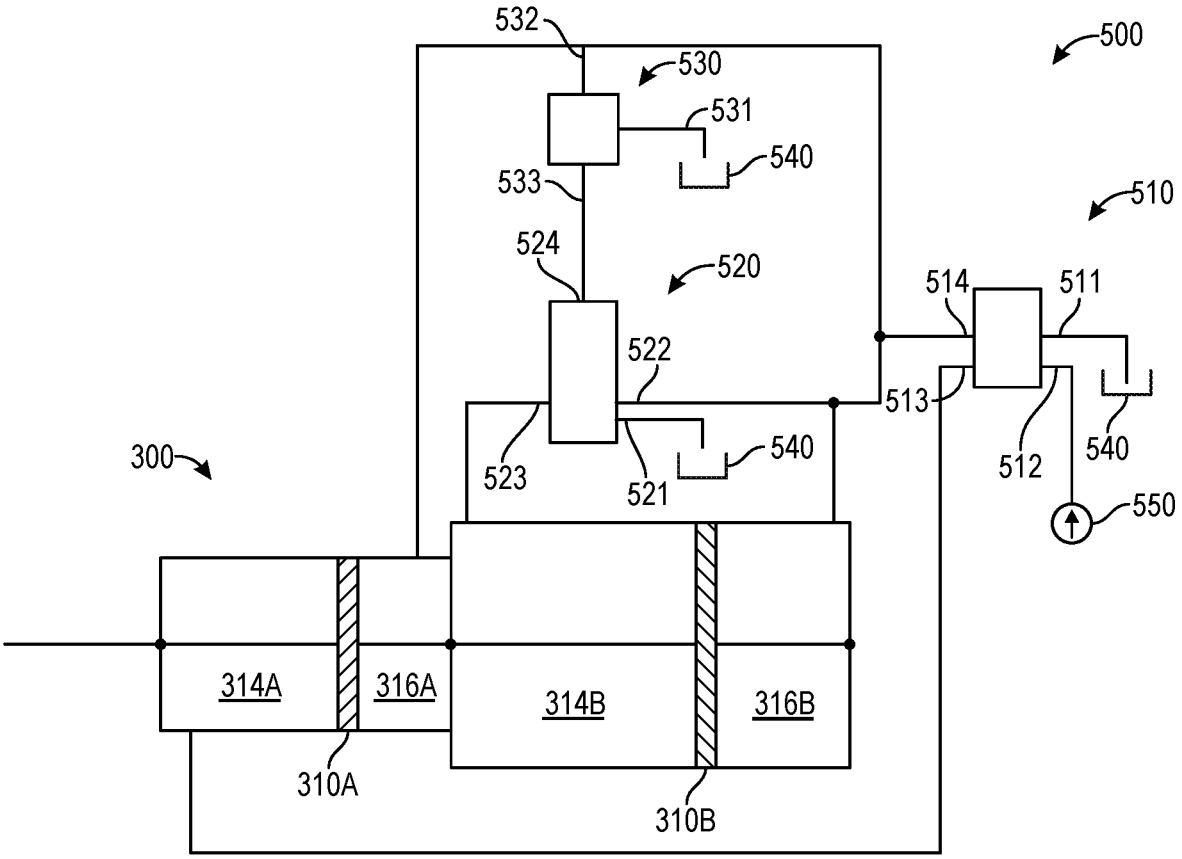
FIG. 5 illustrates a schematic view of a system for operating the BOP, according to an embodiment.

FIG. 5 illustrates a schematic view of a system 500 for operating the BOP 300, according to an embodiment. The system 500 may include the pistons 310A, 310B. The system 500 may also include one or more valves (three are shown: 510, 520, 530) and a tank 540 that may store the fluid.

The first valve 510 may be or include a hydraulic valve. The first valve 510 may include a port 511 that is connected to the tank 540. The first valve 510 may also include a port 512 that is connected to a tank 550. The tank 550 may be the same as the tank 540, or the tanks 540, 550 may be two separate tanks. The first valve 510 may also include a port 513 that is connected to the front volume 314A of the first chamber 312A. The first valve 510 may also include a port 514 that is connected to the back volume 314B of the first chamber 312A, the back volume 316B of the second chamber 312B, the second valve 520, the third valve 530, or a combination thereof.

The second valve 520 may be or include a pilot valve. The second valve 520 may include a port 521 that is connected to the tank 540. The second valve 520 may also include a port 522 that is connected to the back volume 316A of the first chamber 312A, the back volume 316B of the second chamber 312B, the port 514 of the first valve 510, the third valve 530, or a combination thereof. The second valve 520 may also include a port 523 that is connected to the front volume 314B of the second chamber 312B. The second valve 520 may also include a port 524 that is connected to the third valve 530.

The third valve 530 may be or include a sequence valve and/or a discharge valve. The third valve 530 may include a port 531 that is connected to the tank 540. The third valve 530 may also include a port 532 that is connected to the back volume 316A of the first chamber 312A, the back volume 316B of the second chamber 312B, the port 514 of the first valve 510, the port 522 of the second valve 520, or a combination thereof. The third valve 530 may also include a port 533 that is connected to the port 524 of the second valve 520.

The third valve 530 may be configured to actuate the second valve 520 into a first state when the pressure is less than a predetermined threshold, and to actuate the second valve 520 into a second state when the pressure is greater than the predetermined threshold. The pressure may be at the port 532 of the third valve 530, which may be the same as the pressure in the back volume 316A and/or 316B. As described below, the ports 522, 523 may be in fluid communication with one another in the first state, and the ports 522, 523 may not be in fluid communication with one another in the second state. Rather, the ports 521, 523 may be in fluid communication with one another in the second state.

Figure 6:
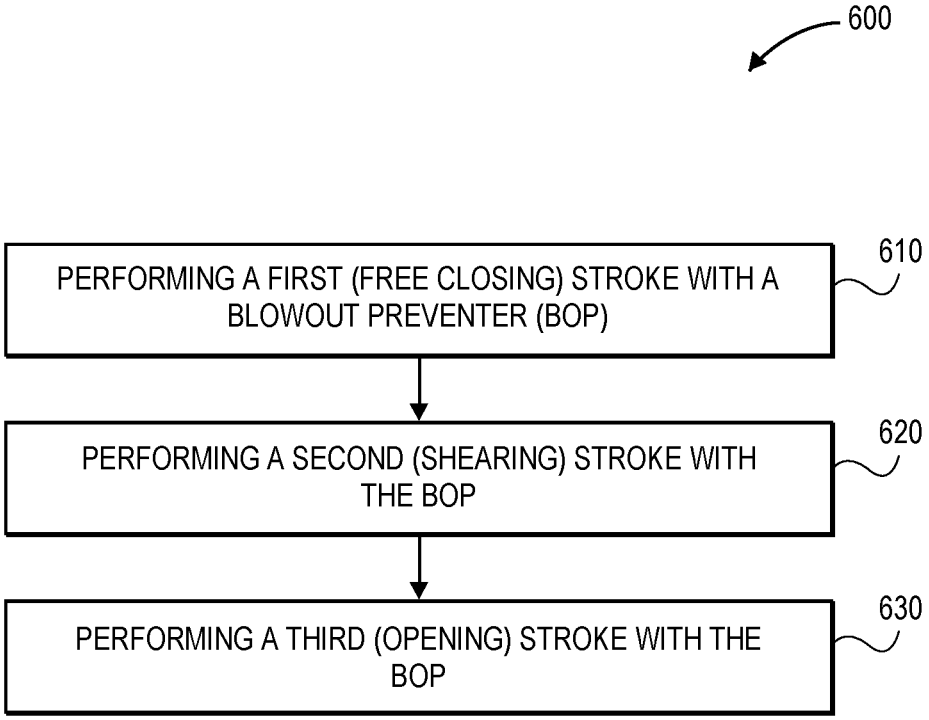
FIG. 6 illustrates a flowchart of a method for operating the BOP, according to an embodiment.

FIG. 6 illustrates a flowchart of a method 600 for operating the BOP 300, according to an embodiment. An illustrative order of the method 600 is provided below, however, one or more aspects of the method 600 may be performed in a different order, combined, split, repeated, or omitted. In the example below, the pistons 310A, 310B of the BOP 300 are initially in the open positions (FIG. 3).

Figure 7:
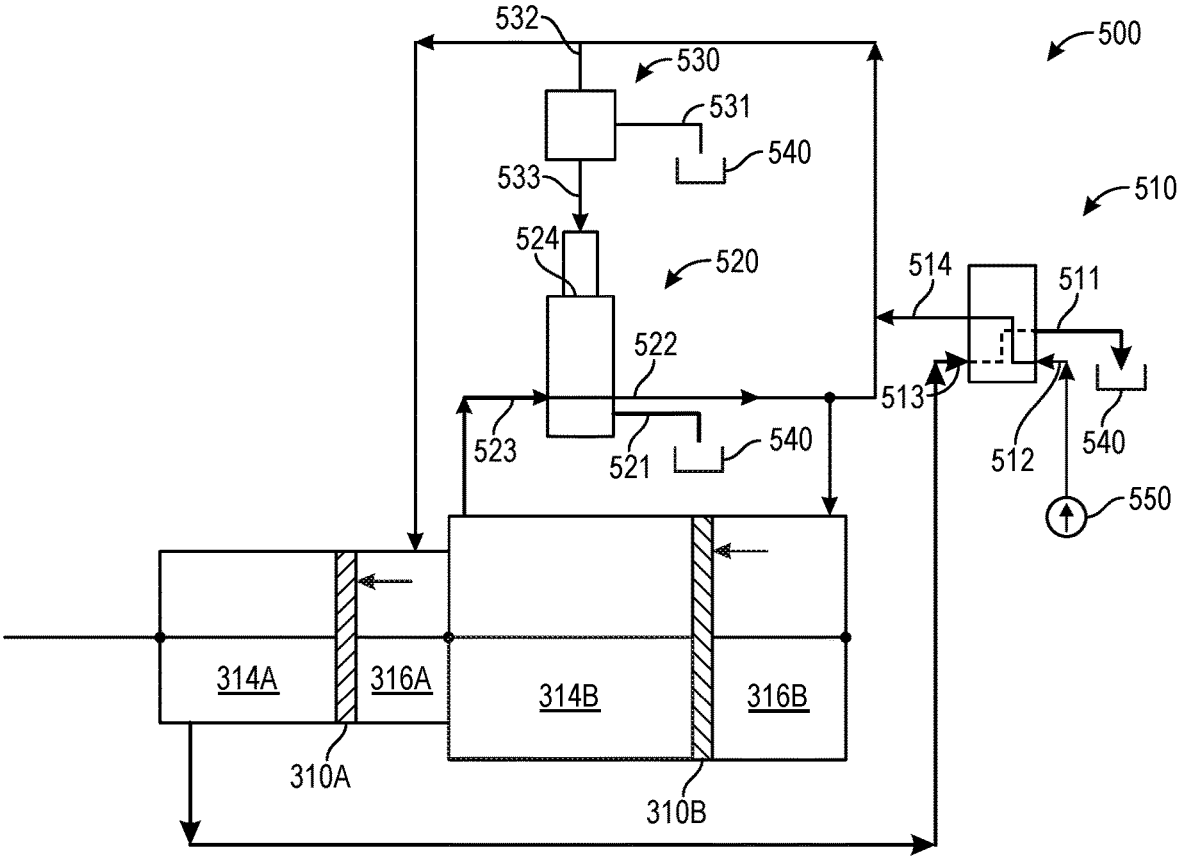
FIG. 7 illustrates a schematic view of the system for operating the BOP with the piston(s) performing a free closing stroke, according to an embodiment.

The method 600 may include performing a first (e.g., free closing) stroke with the BOP 300, as at 610. FIG. 7 illustrates a schematic view of the system 500 with the pistons 310A, 310B performing the free closing stroke, according to an embodiment.

The pressure to perform the free closing stroke may be less than the predetermined threshold (e.g., because the ram(s) 320 is/are moving freely and not yet contacting the tubular member 330). More particularly, the pressure in the chambers 312A, 312B to move the pistons 310A, 310B toward the closed position (to the left in FIG. 7) may be less than the predetermined threshold. For example, the pressure may be about 500 PSI (3.5 MPa).

As mentioned above, the pressure at the port 532 of the third valve 530 may be the same as the pressure in the back volumes 316A, 316B of the chambers 312A, 312B, and thus also be less than the predetermine threshold. In one embodiment, in response to the pressure at the port 532 being less than the predetermined threshold, the third valve 530 may actuate the second valve 520 into the first state to permit fluid flow between the ports 522, 523. This may place the front and back volumes 314B, 316B of the back chamber 312B in fluid communication with one another.

In addition, performing the free closing stroke may also include actuating first valve 510 to permit fluid flow between the ports 511, 513 and/or permit fluid flow between the ports 512, 514. Moreover, performing the free closing stroke may also include actuating third valve 530 to prevent fluid flow between the ports 532, 533. In another embodiment, one or more of the valves 510, 520, 530 may already (e.g., initially) be in these positions and thus may not be actuated into these positions.

Once the valves 510, 520, 530 are in these positions, fluid may be pumped from the tank 550 through the ports 512, 514 of the first valve 510 and into the back volume 316A of the first chamber 312A, which may push the front piston 510A toward the closed position (to the left in FIG. 7). The fluid may be or include a hydraulic liquid (e.g., oil, water, or a combination thereof). As the front piston 310A moves, the fluid in the front volume 314A of the first chamber 312A may be transferred through the ports 511, 513 of the first valve 510 and into the tank 540. As the pistons 310A, 310B are connected together, the movement of the front piston 310A may move (e.g., pull) the back piston 310B toward the closed position (to the left in FIG. 7).

In addition, due to the ports 522, 523 in the second valve 520 being in fluid communication with one another, as the back piston 310B moves, the fluid from the front volume 314B may be transferred through the second valve 520 to the back volume 316B, rather than into the tank 540. In other words, the volumes 314B, 316B may have the same pressure (i.e., be equilibrated). Therefore, the free closing stroke may be performed by pumping the fluid from the tank 550 to a single piston (e.g., the front piston 310A), rather than both pistons 310A, 310B, which may reduce the volume of fluid used.

Figure 8:
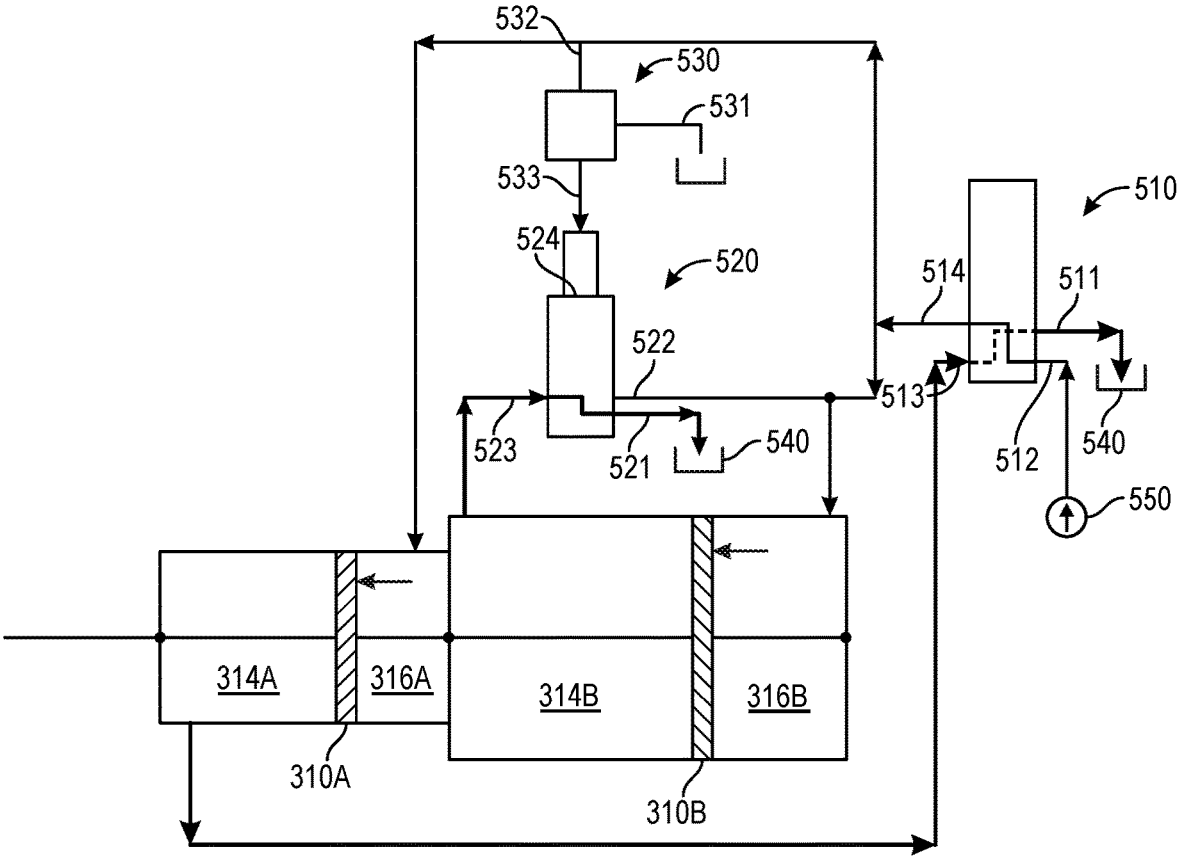
FIG. 8 illustrates a schematic view of the system for operating the BOP with the pistons performing a shearing stroke, according to an embodiment.

The method 600 may also include performing a second (e.g., shearing) stroke with the BOP 300, as at 620. FIG. 8 illustrates a schematic view of the system 500 with the pistons 310A, 310B performing the shearing stroke, according to an embodiment.

At the end of the free closing stroke and/or during the shearing stroke, the ram(s) 320 may contact the tubular string (e.g., drill pipe) 330, which may cause the pressure to perform the shearing stroke to become greater than the predetermined threshold. More particularly, the pressure in the chambers 312A, 312B that moves the pistons 310A, 310B toward the closed position (to the left in FIG. 8), which causes the ram(s) 320 to shear the drill pipe 330, may become greater than the predetermined threshold. For example, the pressure may be from about 1000 PSI (6.9 MPa) to about 1500 PSI (10.3 MPa).

As mentioned above, the pressure at the port 532 of the third valve 530 may be the same as the pressure in the back volumes 316A, 316B of the chambers 312A, 312B, and thus also be greater than the predetermine threshold. In one embodiment, in response to the pressure becoming greater than the predetermined threshold, the third valve 530 may actuate the second valve 520 into the second state to prevent fluid flow between the ports 522, 523 and/or permit fluid flow between the ports 521, 523.

Due to the higher pressure, both pistons 310A, 310B may now be used to perform the shearing stroke. Thus, once the second valve 520 has been actuated, the fluid may be pumped from the tank 550 through the ports 512, 514 of the first valve 510 and into the back volume 316A of the first chamber 312A and the back volume 316B of the second chamber 312B, which may push the pistons 310A, 310B farther toward the closed position (to the left in FIG. 8). As the front piston 310A moves, the fluid in the front volume 314A may be transferred through the ports 511, 513 of the first valve 510 and into the tank 540. As the back piston 310B moves, the fluid in the front volume 314B may be transferred through the ports 521, 523 of the second valve 510 into the tank 540. As may be seen, due to the ports 522, 523 in the second valve 520 no longer being in fluid communication with one another, the volumes 314B, 316B of the second chamber 312B may no longer have the same pressure.

Figure 9:
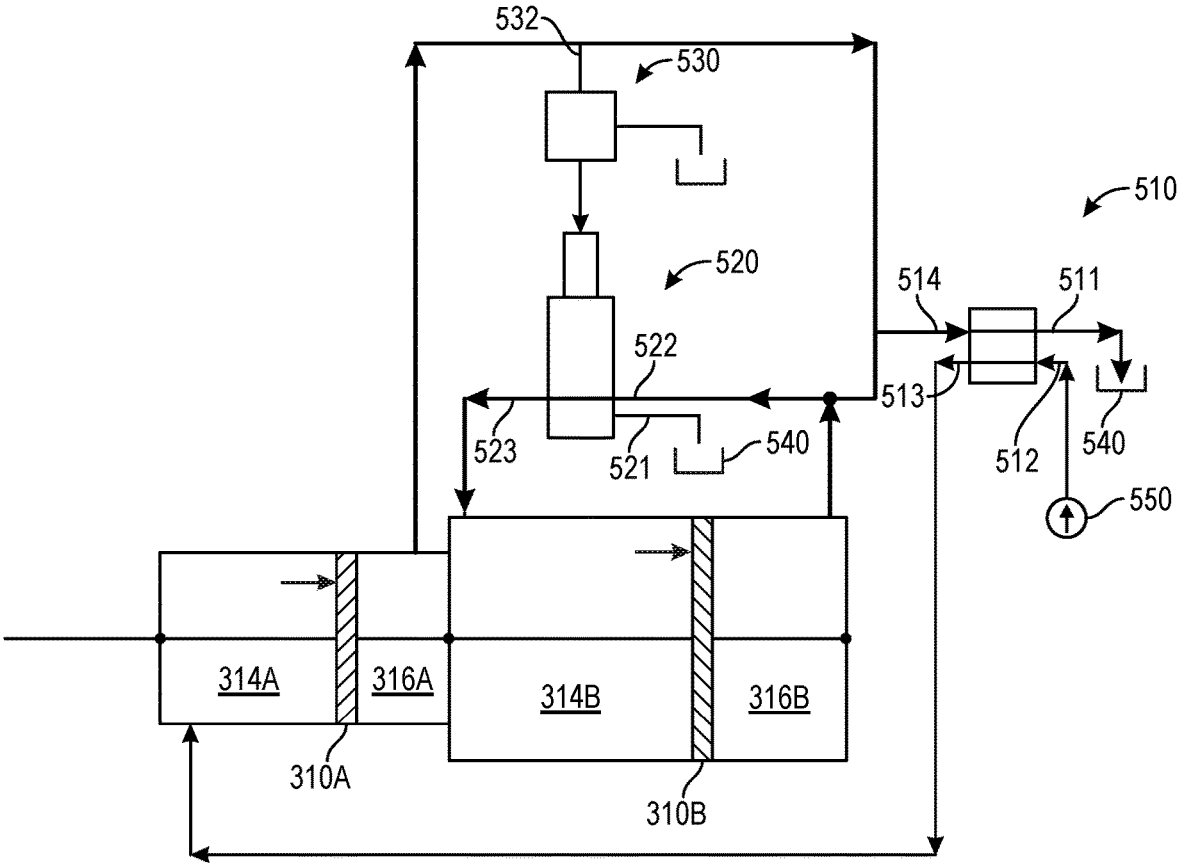
FIG. 9 illustrates a schematic view of the system for operating the BOP with the pistons performing an opening stroke, according to an embodiment.

The method 600 may also include performing a third (e.g., opening) stroke with the BOP 300, as at 630. FIG. 9 illustrates a schematic view of the system 500 with the pistons 310A, 310B performing the opening stroke, according to an embodiment.

After the shearing stroke and/or during the opening stroke, the pressure may once again become less than the predetermined threshold. In response to the pressure becoming less than the predetermined threshold, the third valve 530 may actuate the second valve 520 back into the first state to prevent fluid flow between the ports 521, 523 in the second valve 520 and/or permit fluid flow between the ports 522, 523 in the second valve 520. In addition, performing the opening stroke may also include actuating the first valve 510 to prevent fluid flow between the ports 511, 513, prevent fluid flow between the ports 512, 514, permit fluid flow between the ports 511, 514, permit fluid flow between the ports 512, 513, or a combination thereof.

Once the valves 510, 520, 530 are in these positions, the fluid may be pumped from the tank 550 through the ports 512, 513 in the first valve 510 into the front volume 314A of the first chamber 312A, which may push the front piston 310A toward the open position (to the right in FIG. 9). As the front piston 310A moves, the fluid in the back volume 316A of the first chamber 312A may be transferred through the ports 511, 514 of the first valve 510 and into the tank 540. As the pistons 310A, 310B are connected together, the movement of the front piston 310A may move (e.g., push) the back piston 310B toward the open position (to the right in FIG. 9).

In addition, due to the ports 522, 523 in the second valve 520 (once again) being in fluid communication with one another, as the back piston 310B moves, the fluid from the back volume 316B may be transferred through the second valve 520 to the front volume 314B, rather than into the tank 540. In other words, the volumes 314B, 316B may have the same pressure (i.e., be equilibrated). Therefore, the opening stroke may be performed by pumping the fluid from the tank 550 to a single piston (e.g., the front piston 310A), rather than both pistons 310A, 310B, which may reduce the volume of fluid used.

As will be appreciated, in addition to reducing the amount of hydraulic fluid used, the system 500 and method 600 may also allow the conventional dead chamber to be removed, omitted, or otherwise not used.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A system for operating a blowout preventer (BOP), the system comprising:

a front piston positioned at least partially in a front chamber, wherein the front chamber comprises:
a front volume on a front side of the front piston; and
a back volume on a back side of the front piston;

a back piston connected to the front piston, wherein the back piston is positioned at least partially in a back chamber, wherein the back chamber comprises:
a front volume on a front side of the back piston; and
a back volume on a back side of the back piston;

a first valve configured to permit fluid flow into the front chamber during a free closing stroke of the BOP; and a second valve configured to permit fluid flow between the front and back volumes of the back chamber during the free closing stroke.

2. The system of claim 1, further comprising a third valve configured to cause the second valve to permit fluid flow between the front and back volumes of the back chamber during the free closing stroke in response to a pressure in the back volumes of the first and second chambers being less than a predetermined threshold.

3. The system of claim 1, wherein a pressure differential is exerted on the front piston but not the back piston during the free closing stroke.

4. The system of claim 1, wherein the second valve is configured to prevent fluid flow between the front and back volumes of the back chamber during a shearing stroke of the BOP.

5. The system of claim 4, wherein the front piston is moving toward a tubular member to be sheared during the free closing stroke and the shearing stroke.

6. The system of claim 4, further comprising a third valve configured to cause the second valve to prevent fluid flow between the front and back volumes of the back chamber during the shearing stroke in response to a pressure in the back volumes of the first and second chambers being greater than a predetermined threshold.

7. The system of claim 1, wherein the second valve is configured to permit fluid flow between the front and back volumes of the back chamber during an opening stroke of the BOP.

8. The system of claim 7, wherein the front piston is moving toward a tubular member to be sheared during the free closing stroke, and wherein the front piston is moving away from the tubular member during the opening stroke.

9. The system of claim 7, further comprising a third valve configured to cause the second valve to permit fluid flow between the front and back volumes of the back chamber during the opening stroke in response to a pressure in the back volumes of the first and second chambers being less than a predetermined threshold.

10. The system of claim 7, wherein a pressure differential is exerted on the front piston but not the back piston during the opening stroke.

11. A system for operating a blowout preventer (BOP), the system comprising:

a front piston positioned at least partially in a front chamber, wherein the front chamber comprises:
a front volume on a front side of the front piston; and
a back volume on a back side of the front piston;

a back piston connected to the front piston, wherein the back piston is positioned at least partially in a back chamber, wherein the back chamber comprises:
a front volume on a front side of the back piston; and
a back volume on a back side of the back piston;

a ram connected to the front piston;

a first valve configured to:
permit fluid flow from a tank to the back volume of the front chamber to push the front piston toward a closing position during a free closing stroke of the BOP;
permit fluid flow from the tank to the back volumes of the front and back chambers to push the front and back pistons toward the closing positions during a shearing stroke of the BOP, which causes the ram to shear a tubular member; and
permit fluid flow from the tank to the front volume of the front chamber to push the front piston toward an open position during an opening stroke of the BOP;

a second valve configured to:
permit fluid flow between the front and back volumes of the back chamber during the free closing stroke;
prevent fluid flow between the front and back volumes of the back chamber during the shearing stroke; and
permit fluid flow between the front and back volumes of the back chamber during the opening stroke; and a third valve configured to:
cause the second valve to permit fluid flow between the front and back volumes of the back chamber during the free closing stroke in response to a pressure in the back volumes of the first and second chambers being less than a predetermined threshold;
cause the second valve to prevent fluid flow between the front and back volumes of the back chamber during the shearing stroke in response to a pressure in the back volumes of the first and second chambers being greater than the predetermined threshold; and
cause the second valve to permit fluid flow between the front and back volumes of the back chamber during the opening stroke in response to the pressure in the back volumes of the first and second chambers being less than the predetermined threshold.

12. The system of claim 11, wherein the fluid in the front volume of the front chamber is transferred through the first valve into the tank during the free closing stroke, and wherein the fluid in the front volume of the back chamber is transferred through the second valve into the back volume of the back chamber during the free closing stroke.

13. The system of claim 11, wherein the fluid in the front volume of the front chamber is transferred through the first valve into the tank during the shearing stroke, and wherein the fluid in the front volume of the back chamber is transferred through the second valve into the tank during the shearing stroke.

14. The system of claim 11, wherein the fluid in the back volume of the front chamber is transferred through the first valve into the tank during the opening stroke, and wherein the fluid in the back volume of the back chamber is transferred through the second valve into the front volume of the back chamber during the opening stroke.

15. The system of claim 11, wherein a pressure differential is exerted on the front piston and the back piston during the shearing stroke, and wherein a pressure differential is exerted on the front piston but not the back piston during the free closing stroke and the opening stroke.

16. A method for operating a blowout preventer (BOP), the method comprising:

performing a free closing stroke with front and back pistons, wherein the front piston is positioned at least partially within a front chamber, wherein the back piston is positioned at least partially within a back chamber, and wherein performing the free closing stroke comprises:
pumping fluid through a first valve and into a back volume of the front chamber to push the front piston toward a closing position; and
actuating a second valve to permit fluid flow between front and back volumes of the back chamber, wherein the second valve is actuated by a third valve in response to a pressure in the back volumes of the front and back chambers being less than a predetermined threshold.

17. The method of claim 16, wherein a pressure differential is exerted on the front piston but not the back piston during the free closing stroke.

18. The method of claim 16, further comprising performing a shearing stroke with front and back pistons, wherein performing the shearing stroke comprises:

pumping fluid through the first valve and into the back volumes of the front and back chambers to push the front and back pistons farther toward the closing position; and actuating the second valve to prevent fluid flow between front and back volumes of the back chamber, wherein the second valve is actuated by the third valve in response to the pressure in the back volumes of the front and back chambers being greater than the threshold.

19. The method of claim 16, further comprising performing an opening stroke with front and back pistons, wherein performing the opening stroke comprises:

pumping fluid through the first valve and into a front volume of the front chamber to push the front piston toward an opening position; and actuating the second valve to permit fluid flow between front and back volumes of the back chamber, wherein the second valve is actuated by the third valve in response to the pressure in the back volumes of the front and back chambers being less than the threshold.

20. The method of claim 19, wherein a pressure differential is exerted on the front piston but not the back piston during the opening stroke.

* * * * *